US008453413B2

(12) United States Patent
Matiere

(10) Patent No.: US 8,453,413 B2
(45) Date of Patent: Jun. 4, 2013

(54) REINFORCED CONSTRUCTION ELEMENT

(75) Inventor: Marcel Matiere, Aurillac (FR)

(73) Assignee: Societe Civile de Brevets Matiere, Aurillac (FR)

( * ) Notice: Subject to any disclaimer, the term of this patent is extended or adjusted under 35 U.S.C. 154(b) by 515 days.

(21) Appl. No.: 12/667,750

(22) PCT Filed: Jul. 5, 2007

(86) PCT No.: PCT/FR2007/051603

§ 371 (c)(1),
(2), (4) Date: Jan. 5, 2010

(87) PCT Pub. No.: WO2009/004125

PCT Pub. Date: Jan. 8, 2009

(65) Prior Publication Data

US 2010/0205882 A1 Aug. 19, 2010

(51) Int. Cl.

| | |
|---|---|
| ***E04G 1/00*** | (2006.01) |
| ***E04G 23/00*** | (2006.01) |
| ***E04G 21/00*** | (2006.01) |
| ***E04B 1/18*** | (2006.01) |
| ***B41B 11/54*** | (2006.01) |
| ***B28B 7/30*** | (2006.01) |
| ***F16L 55/18*** | (2006.01) |

(52) U.S. Cl.
USPC ..... 52/741.41; 52/414; 249/173; 249/178; 405/150.1; 405/184.2

(58) Field of Classification Search
USPC ..... 249/153, 173, 178; 405/150.1, 184.2; 52/414, 741.41; 2/153, 173, 178
See application file for complete search history.

(56) References Cited

U.S. PATENT DOCUMENTS

| | | | | |
|---|---|---|---|---|
| 775,927 | A * | 11/1904 | Kahn | 52/336 |
| 2,211,513 | A | 8/1940 | Nagin | |
| 2,558,580 | A | 6/1951 | Pomykala | |
| 3,972,200 | A | 8/1976 | Scarpi | |
| 4,181,556 | A | 1/1980 | Fehlmann | |

(Continued)

FOREIGN PATENT DOCUMENTS

| | | |
|---|---|---|
| EP | 1 191 163 Al | 3/2002 |
| EP | 1 806 460 A1 | 7/2007 |

(Continued)

OTHER PUBLICATIONS

International Search Report, dated Apr. 17, 2008, from corresponding PCT application.

*Primary Examiner* — Andrew Triggs
(74) *Attorney, Agent, or Firm* — Young & Thompson

(57) ABSTRACT

A construction element of reinforced-concrete panel (1) in which is embedded a reinforcement framework includes at least one main framework layer extending along a tensioned outer face (11) of the element (1) and to which an inner framework (3) is attached for securing to the concrete, extending to the thickness of the element (1), the latter being produced, after the placement of the reinforcement framework, by pouring concrete onto a thin continuous wall (2) forming a sacrificial formwork. The thin wall (2) forming the sacrificial formwork extends along the tensioned face (11) of the element (1) and at the same time forms the main framework layer of the element (1), the nature and thickness of the thin wall (2) being determined so as to withstand the tensile stresses generated by the forces applied to the element (1) without the risk of separation from the concrete.

9 Claims, 4 Drawing Sheets

U.S. PATENT DOCUMENTS

| | | | | |
|---|---|---|---|---|
| 4,347,018 | A * | 8/1982 | Wrightson et al. | 405/150.1 |
| 4,767,236 | A * | 8/1988 | Rice | 405/184.3 |
| 5,186,215 | A * | 2/1993 | Gilleland | 138/98 |
| 5,725,026 | A * | 3/1998 | Maimets | 138/97 |
| 6,205,724 | B1 * | 3/2001 | Garling et al. | 52/209 |
| 6,516,506 | B2 * | 2/2003 | Donnelly et al. | 29/451 |
| 6,701,688 | B2 | 3/2004 | Matiere | |
| 6,755,592 | B2 * | 6/2004 | Janssen | 405/184.1 |
| 6,874,651 | B2 | 4/2005 | Matiere | |
| 2008/0193221 | A1 * | 8/2008 | Lee et al. | 405/184.2 |
| 2010/0205882 | A1 * | 8/2010 | Matiere | 52/259 |

FOREIGN PATENT DOCUMENTS

| | | | |
|---|---|---|---|
| FR | 350 857 | | 6/1905 |
| FR | 909 324 | A | 5/1946 |
| FR | 2 849 145 | A1 | 6/2004 |
| FR | 2 864 127 | A1 | 6/2005 |
| WO | WO 02/066770 | A1 | 8/2002 |

* cited by examiner

REINFORCED CONSTRUCTION ELEMENT

The present invention relates to a strong reinforced construction element made of a moulded material, in particular concrete, in which a strengthening reinforcement is embedded.

The "reinforced concrete" technique is know since long ago for the making of any kind of components such as slabs, shells or beams subjected, in particular, to bending stresses, but fluid transportation ducts, in particular of great diameter, are also made this way.

Generally, a metallic reinforcement called a reinforcement cage is first made, which, in the case of prefabricated components, is placed in a mould whose bottom forms a formwork in which fluid-state concrete is poured so as to embed the reinforcement cage therein, the whole being then secured together by the concrete curing process.

In the so-called "tamped concrete" technique, the reinforcement is placed between two formwork walls, which are removed after the concrete has cured.

However, in some cases, it is advantageous to keep the wall that has served as a formwork, for example to ensure the tightness or to seal in the concrete a wall forming the outer face of the component. Such a technique is known since long ago, which is known as the "sacrificial formwork" technique.

For example, in the document U.S. Pat. No. 775,927 dating from 1904, it was already disclosed a technique for making a floor, in which the concrete is poured onto a thin wall forming a sacrificial formwork, also serving as an arch for concrete pouring and curing. For that purpose, the thin wall is corrugated so as to be stiff enough to be placed between two bearings and to support the weight of the concrete during the curing thereof.

The corrugated wall is simply secured to the concrete by connecting tabs that extend into the thickness of the floor. Accordingly, the whole does not form a real reinforcement cage cooperating with the concrete to withstand great loads. Besides, the transverse stresses called "outward pressure" may cause a slight separation of the concrete. Moreover, a corrugated wall cannot withstand transverse tensile stresses that might also cause a separation of the concrete.

Therefore, to make a construction element capable of withstanding the bending stresses resulting from the loads applied, it is preferable to embed into the concrete a conventionally-calculated metallic reinforcement cage in order to withstand the tensile stresses generated by the loads applied to the component while the concrete withstands the compression stresses, the bonding between the concrete and the reinforcement allowing stress transfer from one of the two associated materials to the other due to the adhesion thereof, which, moreover, may be improved by the use of notched bars, for example.

Generally, a reinforced-concrete construction element thus comprises at least one reinforcement mat substantially parallel to an outer face of the component and secured to the concrete by an inner reinforcement embedded in the latter.

In the usual case of a component having, for example, the shape of a beam or a panel with two outer faces spaced apart from one another, the reinforcement usually comprises two mats substantially parallel to each face of the component and connected to each other by stirrups, the whole being embedded in the concrete.

The reinforcement is usually made of steel and is therefore sensitive to oxidation. That is why, normally, each reinforcement mat has to be kept spaced apart from the corresponding outer face of the component by a layer of concrete allowing the reinforcement to be protected against humidity. However, it is difficult to avoid a slight cracking of the outer face of the component, which leads to water coming into contact with the metal, with a risk of oxidation, and thus of concrete spalling, which increases seepage and may result in the failure of the component.

That is why the regulation imposes that a minimum thickness of embedment, normally 30 mm, exists between a metallic reinforcement and the corresponding face-side of the component.

Usually, a reinforcement cage is made of two reinforcement mats made of round bars and connected to each other by stirrups or pins forming an inner reinforcement made of rods of smaller diameter surrounding the main bars.

In order to ensure the required minimum distance of embedment, the reinforcement has thus to be accurately positioned inside the moulded component, using spacers bearing on the formwork, but it is necessary to take into account the diameter of the stirrups that surround the bars.

This minimum distance of embedment, which has to be ensured on the two faces of the component, increases the thickness of the latter, whereas the effective thickness, which provides the component strength, corresponds to only the distance between the two reinforcement mats.

However, it is advantageous to reduce as much as possible the thickness of the concrete components, in particular in the prefabrication technique known as the "Large Panel construction", in which rather large components are made in advance, the latter having to be handled by lift machines. Moreover, the concrete quantity that is used represents a great proportion of the component cost and it is advantageous if this quantity can be reduced while keeping the same strength level.

To this end, the same inventor has already proposed, in the patent application EP 1 191 163 A, a new technique for making a reinforcement cage that allows in particular to reduce the whole thickness of a component, with also other advantages.

In this technique, the reinforcement bars are not made of round rods as usual but of flat bands, rectangular in section, with a large face parallel to the corresponding face-side of the component. Each flat band has a cross section equivalent to that of the round bar, calculated so as to withstand the loads applied, but its rectangular shape makes it possible to easily fasten to its inner face, by welding, the rods that form the inner reinforcement and that are themselves advantageously made of flat bands. Therefore, it is not necessary that such stirrups surround the main bars and it is then possible to reduce the distance of embedment and, consequently, the whole thickness of the component.

It has already been proposed, in the document U.S. Pat. No. 4,181,556, to make a composite panel-shaped component comprising a reinforcement consisting of two parallel metallic sheets in which are cut tabs that are deformed so as to ensure the connection between the two sheets, as two gratings nested in one another, the whole being embedded in a matrix made of a castable product at the semi-liquid state, so as to coat the two parallel sheets, thus making the wall element, which becomes rigid and strong after the matrix has cured.

Such a technique had already been used to make aircraft walls being light-weight, rigid and isolating, but it would be difficult to apply this technique to the making of reinforced-concrete components.

On the other hand, the technique disclosed in the above-mentioned patent application EP 1 191 163 may perfectly be applied to the making of a reinforced-concrete construction element because the reinforcement also comprises two mats consisting of crossed-bars connected to each other by stirrups and whose size and structure characteristics, in particular the cross section, may be determined with the use of the usual formulas for the calculation for reinforced concrete that allow, taking into account notably the elastic limit of the steel and the compression-resistance of the concrete, to calculate the steel section required in the main reinforcement mat that extends along the tensioned outer face of the component, taking into account the distance between this main mat and the neutral line. Indeed, the width and thickness of the flat bands used as main reinforcement may be equivalent to the total cross section of the round bars used in the usual technique.

Another advantage of this new technique is that a flat band rectangular in section has a perimeter far greater than that of one or two round bars having an equivalent cross section, wherein the ratio can be, for example, 1.6. It results that the adhesion between the reinforcement and the concrete, which precisely depends on the perimeter, is increased in the same proportions, which substantially correspond to the advantage provided in reinforced concrete by the use of notched bars or TOR bars.

Therefore, the adhesion between the reinforcement bars and the concrete, on which depend the tensile stress transfer, is substantially the same for flat bands and for notched bars.

Now, it is known that, when the component is subjected to great bending stresses, the bars of the main reinforcement mat placed at a small distance from the tensioned face tend to become longer and, because the notched portions, slightly spaced apart from one another, are blocked in the concrete, it results that, over time, crack fissures occur opposite these notched portions, which may cause seepage and corrosion of the reinforcement.

When, on the contrary, flat bands are used as described in the document EP 1 191 163, the adhesion effect between the main reinforcement and the concrete remains distributed over the length of the reinforcement and the risk of cracking is lesser, the component thus obtained being rather flexible.

However, even if the risk of cracking is reduced, the embedment concrete cannot ensure a perfect tightness when the risk of seepage is great, in particular in the case of liquid transportation ducts or each time the construction element, for example a wall or a floor, is placed in a wet atmosphere. Of course, the risk is still increased in the case of ducts or tanks containing toxic or corrosive products.

Likewise, in the case of ducts for the transportation of drinking water, such as aqueducts, the masonry or concrete wall of the gallery has to be lined with a waterproof lining such as a coat adapted to the transportation of drinking water, which has to be cleaned and sometimes completely replaced.

Furthermore, the aqueducts used for the water supply of towns are generally rather old and, following differential settlements, crack fissures may appear, which cause important water losses and a risk of pollution.

Therefore, the object of the invention is to provide new developments of the technique disclosed in the patent EP 1 191 163, making it possible, on the one hand, to facilitate the making of a reinforced-concrete construction element, using a sacrificial formwork, and on the other hand, to reduce the thickness thereof. Furthermore, the invention also permits to easily ensure tightness in the case of elements placed in a wet or corrosive environment or for lining galleries for the circulation of fluid.

Accordingly, the invention generally relates to a construction element consisting of a reinforced-concrete panel, in which is embedded a strengthening reinforcement that comprises at least one main reinforcement mat extending along a tensioned outer face of the element and to which is fastened an inner reinforcement for securing to the concrete, extending into the thickness of the element, the latter being made, after the placement of the strengthening reinforcement, by pouring concrete onto a continuous thin wall forming a sacrificial formwork.

According to the invention, the thin wall forming the sacrificial formwork extends along the tensioned face of the element and forms at the same time the main reinforcement mat of the element, the nature and thickness of said thin wall being determined so as to withstand the tensile stresses generated by the loads applied to the element without the risk of separation of the concrete.

In a preferred embodiment, the thin wall forming the main reinforcement mat and covering the tensioned outer face of the component forms a continuous sealing skin.

Therefore, whereas in the above-mentioned prior-art patent EP 1 191 163, the reinforcement cage consisting of thin bands was able to be made in the same way as a conventional reinforcement cage consisting of round bars embedded in the thickness of the element, according to the invention, the main reinforcement mat is now placed at the tensioned outer face of the element, such that the distance of embedment is eliminated, the thickness of the element thus being further reduced.

Of course, the thin wall, which then serves as a main reinforcement, has to be capable of withstanding corrosion, and to this end, it may be made of a stainless metal or contain glass or carbon fibres, or it may be covered with a suitable coating, wherein the cost increase that results therefrom can be compensated for by the advantages provided by the invention.

The invention permits the making of components such as slabs or shells, but it may also be advantageously applied to the making of ducts for the circulation of a corrosive fluid or for the transportation of drinking water and, generally, the making of any waterproof structure, for example the body of a ship, barge or other floating object.

In particular, the invention permits the making of a waterproof lining in a gallery that is masoned or dug into the natural ground, said lining comprising a thin wall introduced inside the gallery and separated from the inner face thereof by a gap in which is injected a strong mouldable material such as concrete, in which a securing inner reinforcement is embedded.

According to the invention, the size and structure characteristics of the thin wall and of the inner reinforcement are determined so that the whole lining is capable of withstanding the loads applied in result of outward pressure forces, of the pressure in operation and of possible differential settlements of the gallery.

Particularly advantageously, the inner reinforcement consists of a plurality of corrugated bands parallel to the longitudinal axis of the duct and distributed around the latter, said bands being welded at at least some tops of the corrugations to the inner face of the thin wall.

In a preferred embodiment, the lining consists of successive sections, each comprising a rectangular thin-wall panel with a length corresponding to the length of the section and a width corresponding to the cross-sectional perimeter of the duct. This panel is firstly placed flat so as to place on an upper face thereof an inner reinforcement comprising at least a plurality of corrugated bands parallel to a longitudinal axis of the panel and spaced apart from one another, said bands being welded to the upper face of the panel at at least some tops of the corrugations; the panel is thereafter wound up so as to form a tube with a whole diameter smaller than that of the gallery, the corrugated bands being directed outwardly, and the wound-up panel is introduced into the gallery up to the location of placement and is unwound so as to rest against the lateral face of the gallery at the tops of the corrugated bands; said panel is then welded, on the one hand, along the two longitudinal sides that have come into contact and, on the other hand, along an end transverse side, to the corresponding end side of the last section already in place, and a mouldable material such as concrete is injected into the gap between the thin wall and the lateral face of the gallery, so at to embed the inner reinforcement and to secure the whole.

The invention also relates to the tools used for implementing the method.

Indeed, after the making, in a flat state, of the panel provided with corrugated bands forming the inner reinforcement, this panel is wound up by means of a winding tool comprising two circular plates rotating around an axis, on which plates are fastened the ends of a profile arranged on one of the longitudinal sides of the panel, which is wound over more than one turn by the rotation of the plates around their axis.

Thereafter, this wound-up panel is introduced into the gallery by means of an unwinding tool comprising a central shaft carrying two movable arms at its ends and mounted rotating on two rotationally-fixed bearings, carrying respectively two spaced-apart arms whose spacing is slightly greater than the length of one panel, each pair of arms being provided with a clamping member; the unwinding tool is then inserted into the wound-up panel so that the clamping members respectively carried by the arms of the bearings engage the ends of a side profile placed on the outer side of the wound-up panel whereas the clamping members of the arms of the central shaft engage the ends of a profile placed on the inner side of the wound-up panel, said panel being then placed at its position of placement by advancing the tool inside the gallery and being thereafter unwound by rotating the movable arms until the inner profile goes beyond the position of the outer profile, and the opposite edges of the panel are then tightly sealed together along the lateral sides as well as along the adjacent transverse sides, respectively of the last section already placed and of the new section.

In a preferred embodiment, the unwinding tool is mounted on a transport truck such as a lift truck, whose dimensions are compatible with those of the gallery to be lined, in order to be introduced therein.

But the invention also relates to other applications and other advantageous features that will be revealed by the following description of particular embodiments given by way of example and shown in the appended drawings.

Figure 18:
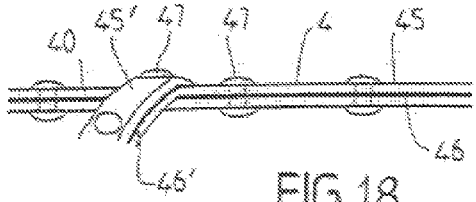
Figure 15:
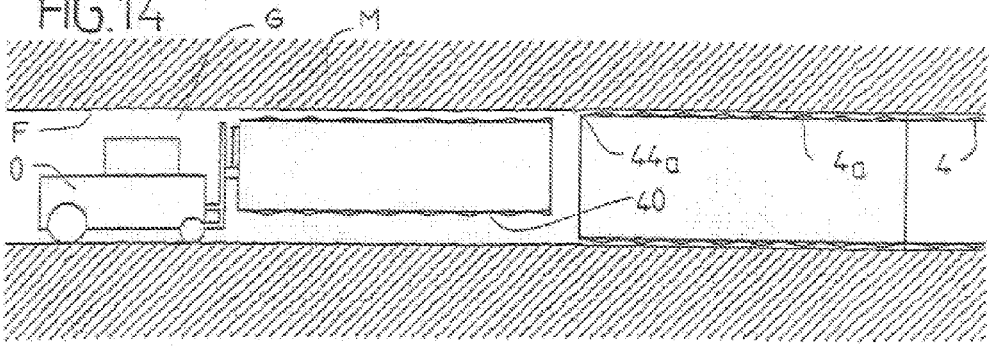
Figure 17:
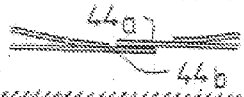
Figure 16:
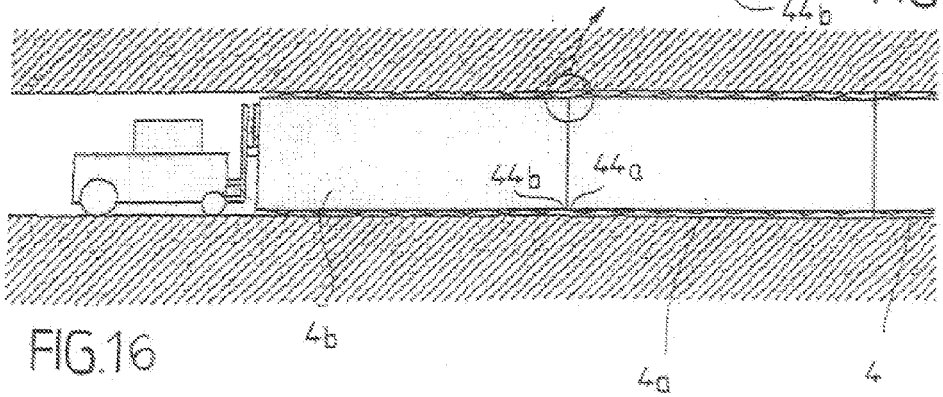

FIGS. 15 and 16 schematically illustrate the placement of a new wall element inside a gallery;

FIG. 17 is a detailed view of the nesting between two consecutive elements;

FIG. 18 schematically shows the making of a waterproof connection between two successive lining elements.

Figure 1:
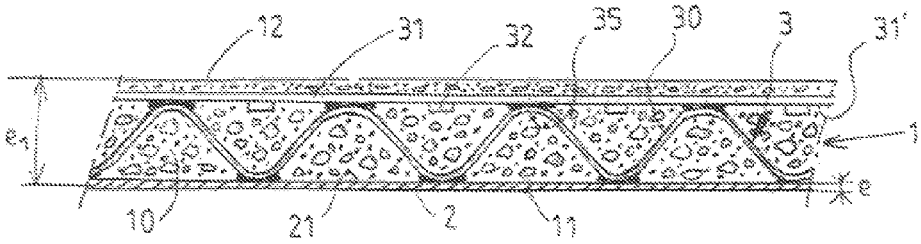
FIG. 1 is a partial cross-sectional view of a composite component according to the invention.
Figure 2:
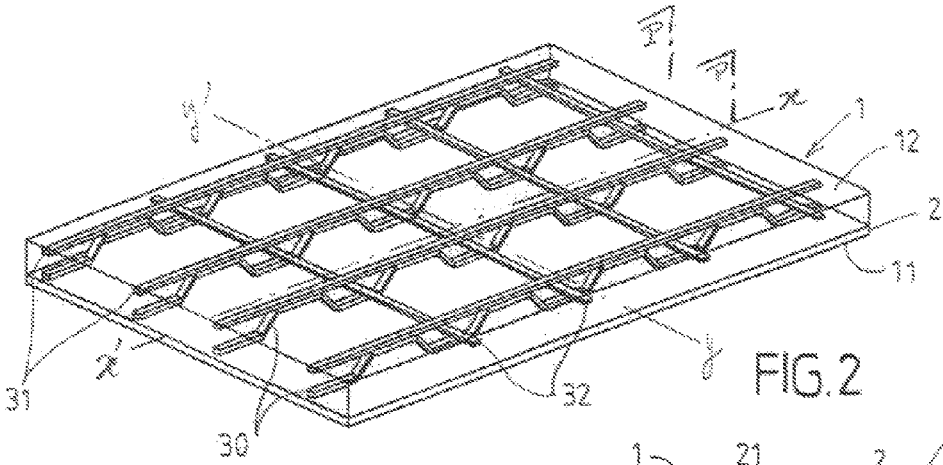
FIG. 2 is a schematic perspective view of the construction of a slab according to the invention.

FIG. 1 and FIG. 2 are respectively longitudinal and perspective cross-sectional views of a reinforced-concrete slab 1, rectangular in shape, with a longitudinal axis x'x and a transversal axis y'y. As usual, this slab is made by moulding concrete 10 into a formwork and has two outer faces referred to as face-sides 11 and 12, between which extends a reinforcement cage 3 embedded in the concrete 10.

Usually, the reinforcement cage presents two mats of longitudinal and transverse bars, respectively placed at a minimum distance of embedment of the outer faces 11 and 12, and connected to each other by an inner reinforcement made of wires of smaller section, the number of bars of each mat and the cross section thereof being determined by a calculation material strength as a function of the loads to be supported by the slab. In particular, if the slab is subjected to a bending stress under the effect, for example, of a vertical load, its lower face 11 is tensioned and its upper face 12 is compressed, and the sections of the reinforcement mats are calculated accordingly, in particular for the lower mat subjected to tensile stresses.

As exposed in the European patent EP 1 191 163 of the same inventor, it is particularly advantageous to use, in order to form the reinforcement mats, flat bars having a flattened rectangular section equivalent to the section calculated for the round bars, but the large face thereof is parallel to the corresponding outer face of the component, the inner reinforcement further consisting of thin corrugated bands alternately fastened, at the tops thereof, to the inner faces of flat bars forming the two mats. Such an arrangement makes it possible to substantially reduce the distance of embedment between each mat of flat bars and the corresponding outer face of the component, and accordingly the whole thickness of the latter.

The slab made according to the invention and shown in FIGS. 1 and 2 also comprises a reinforcement cage 3 consisting of thin bands, but essentially differs from the arrangement described in the patent EP 1 191 163 in that the main reinforcement mat, i.e. the one placed, with respect to the neutral line, on the side of the tensioned face 11 of the component, consists of a metallic thin wall 2 covering at least a portion of the outer face 11 of the component 1 and having therefore an inner face 21 applied to the concrete 10 and to which are fastened corrugated bands 30 forming the inner reinforcement.

The thin wall 2, which extends over the whole surface of the tensioned face 11, thus forms a sacrificial formwork facilitating the making of the element 1, in particular if the latter is prefabricated.

On the compressed side of the component 1, the reinforcement mat may be formed, as in the arrangement described in the patent EP 1 191 163, of longitudinal thin bands 21 connected to each others by transverse bands 32.

The corrugated bands 30 forming the inner reinforcement are alternatively welded or bound, at the tops thereof 34, 35, to the inner face 21 of the thin wall 2 and to the inner faces 31' of the upper bands 31, respectively.

According to the invention, the thickness e of the wall 2 is determined as a function of its width and taking into account its mechanical characteristics, so as to obtain in cross section a surface equivalent to that resulting of the calculation of material strength and which would be covered by a certain number of round-section reinforcement bars, in the conventional technique, or of several rectangular-section flat bands, in the technique of the patent EP 1 191 163.

Therefore, the thin wall 2 fulfills a dual role. On the one hand, it forms in a conventional manner a sacrificial formwork for the making of the slab and, on the other hand, it constitutes a main reinforcement mat withstanding the tensile stresses generated in the lower part of the slab, under the effect of the loads applied. Furthermore, this thin wall may also constitute a protective lining and possibly a sealing skin for the outer face 11 of the slab.

As shown in FIG. 2, the longitudinal flat bands 31 and the corrugated bands 30 are conventionally arranged into several sections centred in planes P parallel to the longitudinal axis x'x of the slab and connected to each others by the transverse bands 32, which preferably extend underneath the longitudinal bands 31 and are applied to the inner faces 31' thereof. On the other hand, at the lower level, no transverse reinforcement is necessary because the whole main reinforcement mat is formed by the continuous wall 2.

The arrangement according to the invention permits, by placing the main reinforcement mat at the outer face 11 of the slab, to eliminate the concrete thickness corresponding to the minimum distance of embedment and thus to reduce the whole thickness el of the beam.

Moreover, as mentioned hereinabove, the use of flat bands as longitudinal reinforcement bars permits, for an equivalent section, to substantially increase the perimeter and to obtain accordingly an adhesion of the same order than that of a notched bar.

In the invention, the thin wall 2 which constitutes the main reinforcement mat is in contact with the concrete only on its inner face 21 but, because it extends over the whole surface of the element, the adhesion remains still far higher than that of the round bars conventionally used. Consequently, when the element 1 is subjected to bending stresses resulting, for example, from the application of a vertical load, the thin wall 2 covering the tensioned face 11 may become slightly longer without risking a separation of the concrete, the adhesion effect being distributed over the whole surface of the tensioned face 11.

In this case, the upper face 12 of the element is compressed, but it is to be noted that, if the corrugated bands 30 are welded to the upper reinforcement 31 at only some of the tops 35 thereof, the whole element may slightly deform while remaining rather flexible.

Moreover, this adhesion effect between the inner face 21 of the wall 2 and the concrete 10 may be increased through application of a suitable treatment to this face 21 of the wall 2.

For example, it is known that, at the end of the rolling process, it is possible, in a surface treatment or a rolling process known as "skin pass", to provide the sheet metal with a particular quality of surface, for example by making slight scratches providing an adhesion increase.

According to an alternative embodiment, the thickness e1 would be further reduced by also making the upper reinforcement mat in the form of a continuous thin wall covering the upper face 12 of the slab.

Because the reinforcement mat is no longer covered with concrete, it is in contact with the external medium and may thus be oxidized if it is made of metal. However, the thin wall 2 being exposed, it is easy to control its condition and possibly to remedy the situation, for example by a protective treatment. On the other hand, in a conventional reinforced-concrete component, the reinforcement bars are precisely hidden by the embedment concrete and their oxidation condition often appears too late, when the concrete spalling begins.

Moreover, because the wall 2 is placed outside, it may be covered with a protective coating, as paint, or galvanized or stainless metal sheets may be used.

Indeed, the invention offers such advantages, by the reduction of the quantity of concrete used and by the use of the reinforcement mat as a sacrificial formwork and protective and/or sealing skin, that is will often be cost-effective to make it of stainless steel, all the more since the distribution of the tensile stresses over the whole width of the thin wall 2, i.e. possibly over the whole width of the element 1, permits to obtain the necessary cross section with a very small thickness.

Likewise, due to the advantages offered, it may be cost-effective to use high-elastic-limit steels.

In this case, it is also advantageous to make the bands 31 and 32 forming the upper reinforcement mat and the corrugated bands 30 forming the inner reinforcement of a metal of same nature, for example stainless steel. Indeed, it is easier to weld metals of the same nature, possibly by simple electrical contact, and the making of the upper mat with stainless steel bands makes it possible to further reduce the thickness of embedment along the upper face 12 of the slab.

The invention has been described by way of example in the case of a slab, but, of course, it may apply to any kind of component, for example beams or curved shells. Moreover, as described hereinabove, the corrugated bands 3 are not necessary welded at all their tops. In particular, the welds of the upper tops 35 could be eliminated, which would permit to provide the thin wall 2 with the curvature of a curved shell.

It is then possible to make shells of any nature, wherein the thin wall 2 may, in case of need, have a wrap profile obtained by a drawing process.

Insofar as the thin wall 2 covering the element 1 constitutes both a reinforcement mat and a protective skin, it is particularly advantageous to make this way the wall of a tank, made of a series of prefabricated panel, each comprising a strong reinforced-concrete wall covered, on its inner face, with a sealing sheet.

Figure 3:
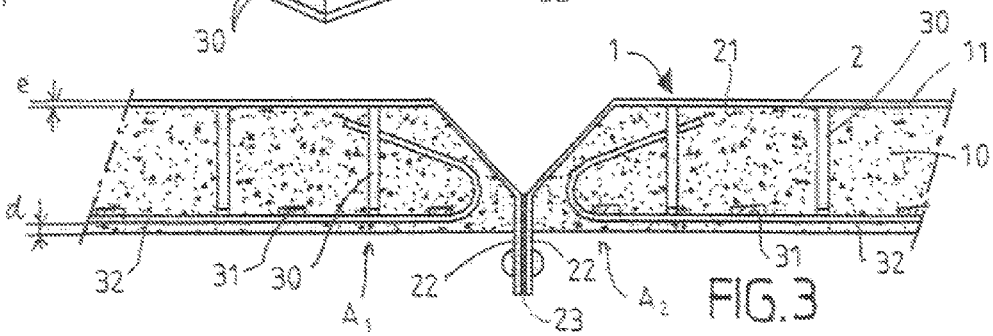
FIG. 3 is a horizontal cross-sectional view of the connection between two panels forming a tank wall.

FIG. 3 is a partial cross-sectional view of the wall of a tank made this way, comprising a series of adjacent panels A1, A2, each made of a prefabricated element 1 having an inner face 11 covered with a sealing sheet 2.

Such a process has been described in details in the International Patent Application WO 02/066770 of the same inventor.

In the prior arrangement, each concrete prefabricated panel is made in a conventional manner so as to withstand by itself the loads that are applied and, in particular, to the pressure of the fluid contained in the tank, while the sheet that covers it is simply provided to ensure tightness and may thus be very thin because it undergoes no stress.

On the other hand, in the invention, the sealing sheet 2 that covers each panel 1 constitutes a reinforcement mat, and the thickness thereof has thus to be determined as a function of the loads to be supported.

As shown in FIG. 3, the reinforcement cage 3 embedded in the concrete 10 thus comprises two reinforcement mats connected to each other by corrugated bands 30, respectively a first mat consisting of the wall 2 covering the inner face 11 of the element 1 and a second mat extending along the outer face 12 and consisting of two series of bands, respectively longitudinal bands 31 and transverse bands 32.

In the example shown in FIG. 3, these are the transverse bands 32 that are placed outside the cage 3 and that are separated from the outer face 12 of the panel by a minimal distance of embedment d, which may be reduced due to the use of flat bands as reinforcement.

According to an arrangement described in the patent application WO 02/066770 of the same inventor, the sides of the walls 2 covering the inner faces 11 of two consecutive panels A1, A2 are folded back in order to cover the lateral side of said panels and are extended outwardly by parts 22 applied to one another, with a seal 23 interposed between them.

Figure 4:
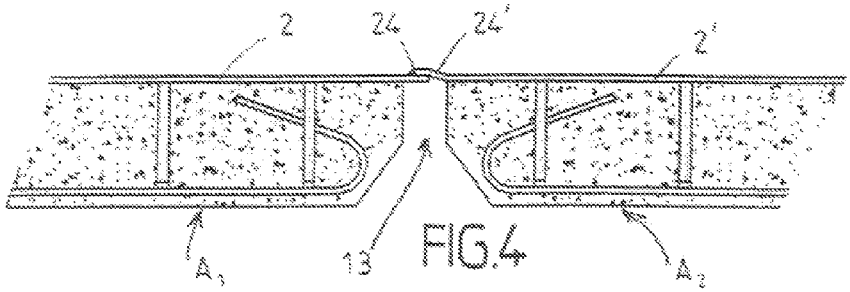
FIG. 4 shows another embodiment of the connection between two wall panels.

However, it may be advantageous to leave a free space, for example of 3 or 4 cm, between two consecutive panels A1, A2, so as to compensate for the expansions and for slight differential settlements. In this case, shown in FIG. 4, the two metal sheets 2, 2' covering the inner faces 11 of the two consecutive panels A1, A2, respectively, are extended, on each side, by side parts 24, 24' welded to each other or connected to each other with a seal interposed between them, so as to make a continuous sealing skin. Indeed, because the thicknesses thereof are determined so as they play the role of a reinforcement mat taking part in the strength, the parts 24 welded to each other can withstand the pressure of the liquid contained in the tank, at the space 13 between two consecutive panels A1, A2.

Such an arrangement leaves flexibility to the tank wall and allows it to adapt to slight disorders due to the differential settlements, the expansions and even to the earthquake.

Preferably, such a tank will be buried at least partially, the embankment will be placed outside, allowing to balance the thrust of water or another fluid contained in the tank. However, the characteristics of the panels, of the wall 2 that covers them and of the flat bands forming the reinforcement cage 3 will be determined in order to provide the tank with a structure that allows it to withstand the water thrust before embankment, for example for a tightness test, and, reversely, to the thrust of the ground and of the phreatic water, applied from the outside of the empty tank.

Moreover, the panels will be preferably prefabricated in factory and transported to the site. To this end, they may have a height of, for example, about 4 to 6 m and a width limited to 2.5 m to conform to the road loading gauge. Each panel may advantageously be provided with stiffening ribs 16, the reinforcement cage being adapted accordingly.

Such a tank may be circular or rectangular in shape. In the case of a circular shape, the panels may be curved and, preferably, provided, at their lateral side, with male and female parts forming a ball joint, so as to standardize the panel whatever the diameter of the tank. It may also be used plan panels laterally fastened to vertical studs.

In the case of a rectangular tank, it may be used plan panels and angle panels 17 forming, for example, a right angle.

The invention also permits the making of ducts for the transportation of fluids, in particular drinking water if the lining wall is made of stainless steel.

Figure 5:
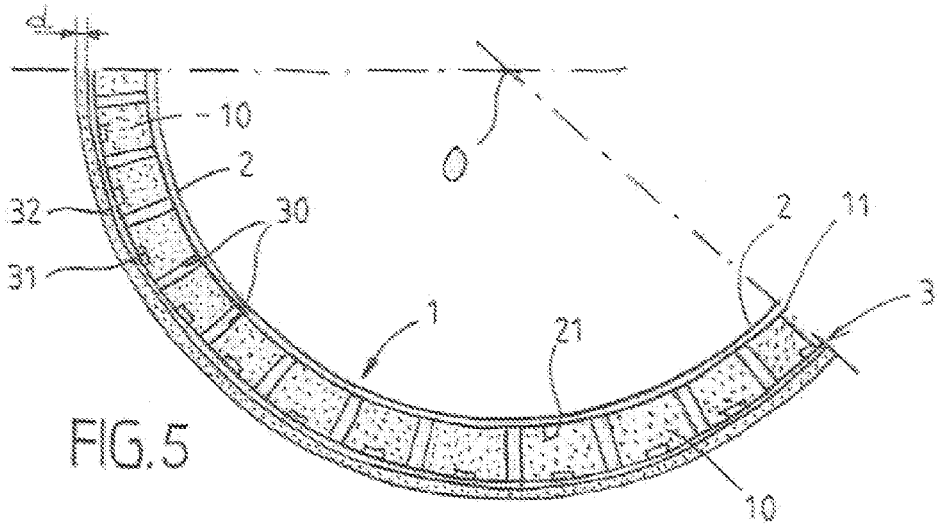
FIG. 5 is a partial cross-sectional view of a duct wall made according to the invention.

FIG. 5 is a partial cross-sectional view of such a duct comprising an inner lining wall 2, preferably circular in section, which constitutes a first reinforcement mat, connected by corrugated bands 30 to a second reinforcement mat, which consists of longitudinal bars 31, parallel to the axis of the duct, and of transverse bars 32 placed in planes perpendicular to the axis and forming circular screeds parallel to the outer face 12 of the duct and separated therefrom by a minimum distance of embedment d. The corrugated bars 30 are advantageously sinusoidal in shape and are arranged in a star configuration in radial plans passing through the duct axis.

As hereinabove, the whole thickness (e1) of the duct 1 and the characteristics of the inner wall 2 and of the flat bands constituting the reinforcement cage 3 are determined as a function of the loads to be supported. It is to be noted, in particular, that the duct is particularly adapted to the transportation of fluid under pressure, the wall 2 being then simply subjected to tensile stresses that are particularly well withstood by a cylindrical metallic wall. The tensile stresses being taken by the cylindrical wall 2, the risk of cracking of the concrete 10 is reduced.

But the reinforcement cage 3 comprising the inner wall 2, the outer mat 31, 32 and the corrugated bands 30, may also be calculated so as to withstand the loads applied from the outside by an embankment when the duct is buried and is not subjected to an inner pressure allowing the embankment load to be compensated for. Likewise, because of the use of the inner wall 2 as a reinforcement mat secured to the concrete 10 by the corrugated bands 30 and the outer mat 31, 32, it is possible to make, in this manner, prefabricated sections possibly provided with means for the fastening of slings, wherein the reinforcement cage 3 made according to the invention may be calculated so as to withstand the stresses generated during the transportation.

But the invention also permits to make, in a particularly advantageous manner, the casing of a gallery for the transportation of water, in particular for the renovation of an existing aqueduct.

Figure 6:
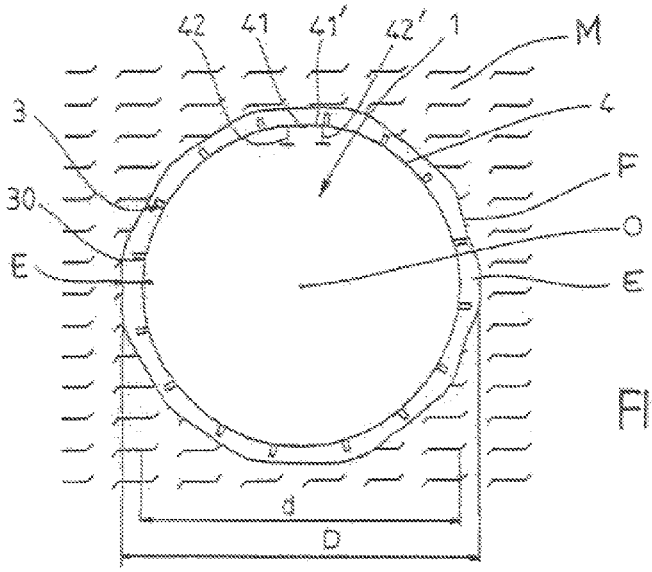
FIG. 6 is a schematic transverse cross-sectional view of a gallery provided with a lining according to the invention.

FIG. 6 is a schematic cross-sectional view of a gallery G that is made, for the transportation of water inside a massif M, which may be a compact or rocky ground when the gallery is made as a tunnel, or a masoned massif, for example millstone or brick masoned. Conventionally, such a duct for the transportation of drinking water has generally a closed section so as to avoid the risk of pollution and evaporation of water.

The gallery G is thus limited by an inner face F having any cross section, but generally a circular cross section, as indicated in the drawing, or, for example, an ovoid cross section. Even when the support massif surrounding the gallery is masoned, the inner face F is rather irregular, and, further, more or less permeable. Thus, this face F must be covered with a ruled and waterproof plastering or rendering, so as to allow the water flowing without any load loss and without leakage, this plastering having further to be adapted to the transportation of drinking water.

In this particular application of the invention, this plastering is replaced by a thin metallic wall 4, preferably made of stainless steel.

Indeed, it is particularly advantageous, for an aqueduct, to use as the lining such a metal, which is the most appropriate for the transportation of water, because it is entirely neutral and resists perfectly to the corrosion. Furthermore, stainless steel sheets, even in contact with water, remains bright and smooth and thus permit an easy flowing with little swirl and load loss.

Indeed, such a metal is rather costly but, when fabricated and supplied in great quantity, the cost thereof remains rather limited, and thus it appeared that, taken into account the very great advantages provided by such a stainless steel lining, in particular, a best flowing of the water and resistance to corrosion and to dirt that permit to simplify the maintenance and cleaning and to significantly increase the service life of the lining, wherein the use of stainless steel may be finally more cost-effective than a conventional mortar plastering, which has to be itself covered with a coating which is tight enough, wear-resistant and compatible with the transportation of water. Furthermore, because the thin wall constitutes both the protective lining and the reinforcement mat, the cost thereof also comes in deduction of that of the inner reinforcements it replaces, which justify the economical interest of the invention.

The diameter (d) of the lining wall 4 is a little smaller than the diameter (D) of the gallery, so as to leave, between the wall 4 and the inner face F of the gallery, a gap E into which is poured or injected, after the wall 4 is placed, a fixing product, such as a cement mortar or a concrete of rather fine particle size, to fill the whole gap 4, which thickness remains of course small, normally lower than 10 cm.

The lining wall 4 of the gallery is formed of a series of successive sections, each made of a thin-wall panel, substantially rectangular in shape, wound around a longitudinal axis O.

According to the invention, this lining wall 4 constitutes a reinforcement mat, and the thickness thereof is thus determined, taking into account the elastic limit of the stainless steel, so as to withstand the foreseeable stresses. Usually, an aqueduct operates in free flowing and thus is not under pressure, but the invention permits precisely to operate under an inner pressure of the order of 1 or 2 bars, which allows a flow-rate increase.

Moreover, the gallery G may be subjected to an external pressure, for example that of an embankment or of a phreatic water when it is buried. In this respect, the use, according to the invention, of a strong metallic wall for making the inner lining of the gallery allow the withstanding of differential settlements liable to cause crack fissures in the masoned galleries.

Generally, the inner lining wall, made of food-grade stainless steel, may have a thickness of the order of 1 to 1.5 mm. The lining may thus consist of thin plates having a width corresponding to the perimeter of the gallery, for example 6 m for a gallery of 2 m in diameter and 4 to 6 m in length, which, however, depends on the layout of the gallery, wherein the latter may present bends.

These plates having dimensions greater than the road loading gauge, normally, coils of stainless steel will be supplied to the building site, each coil being unwound to cut the plates forming the lining panels.

Figure 7:
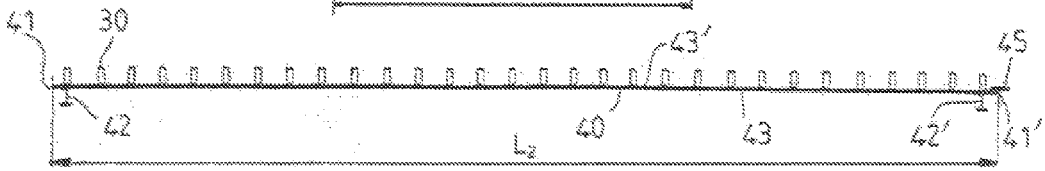
FIG. 7 is a transverse cross-sectional view of a lining panel laid flat.
Figure 8:
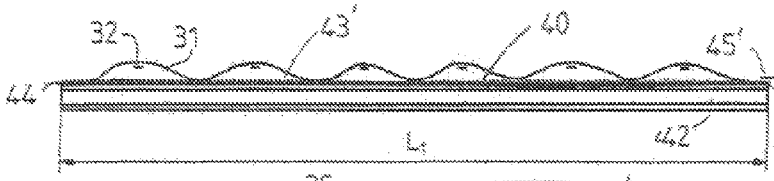
FIG. 8 is a longitudinal cross-sectional view of the lining panel.

These plates will be prepared in a flat state, as schematically indicated by FIGS. 7 and 8, which show the making of a panel, respectively in transversal cross-sectional view in FIG. 7 and in longitudinal cross-sectional view in FIG. 8.

The length L1 of a panel (FIG. 8) may be equal to the width of a band supplied as a coil.

If this width is not sufficient, it is possible to unwind several coils in parallel strips, welded side-to-side, so as to form plates having the desired width, for example, about 5 meter.

On the other hand, because the panel is cut from an unwound coil, it may have any the width L2. According to one of the characteristics of the invention, the width L2 of the panel will be substantially equal to, or only a little smaller than, the cross-sectional circumference of the inner face F of the gallery, so that, as shown in FIG. 6, after the winding of the panel around its longitudinal axis O, the two lateral sides 41 and 41' of the panel 4 come into contact with each other, or slightly overlap each other, or are covered with a joint cover 45 allowing the nesting thereof.

It is to be noted that, in FIG. 6, a gallery G circular in section has been shown, but the cross-sectional profile of the gallery may be, for example, ovoid in shape or even present a flat bottom.

Generally, each wound panel has a cylindrical shape, the word "cylindrical" applying to any ruled surface with generating lines parallel to the longitudinal axis O.

The plate 40 forming a panel is thus cut from the stainless steel coil and is laid on two side profiles 42, 42' parallel to the longitudinal axis O and having a length substantially equal to the length L1 of the panel.

Advantageously, the gap E between the lining 4 and the inner face F of the gallery is not only filled with a fixing product, but also reinforced by a reinforcement 3 comprising preferably a plurality or longitudinal stirrups 30 spaced apart from one another and distributed over the whole width L2 of the panel.

As above, these stirrups 30 are preferably each formed of a corrugated metallic band, which can then be welded, at the tops of the corrugations, to the upper face 43' of the panel 40, which, after winding of the panel, constitutes the outer face thereof directed toward the annular gap E. However, these stirrups could also be formed of separated band sections, welded or bonded, at an end thereof, to the wall 50, and extending in the gap E between the metallic wall 40 and the inner face F of the gallery G.

Figure 9:
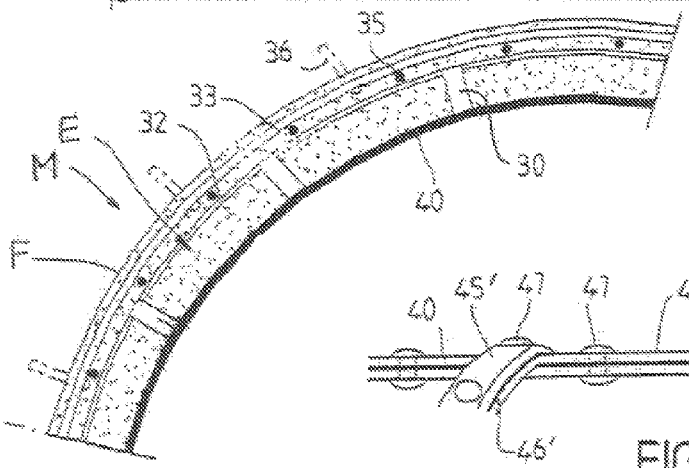
FIG. 9 is an enlarged partial view of the lining and the reinforcement thereof.

As shown in FIGS. 7, 8, 9, these corrugated stirrups 30 are arranged in planes parallel to the longitudinal axis O, such that, after the winding of the panel 40, they are arranged in a star configuration in radial plans, as shown in FIG. 6. The reinforcement 3 is completed by transverse bars 32 that may be round bars, but that preferably consist of flat bands that are inserted into the corrugations of the stirrups 30, at the upper tops thereof. Each bar 32 is fixed only to one of the stirrups so that it can slide with respect to the other stirrups when the panel 40 is wound. Therefore, as shown in FIG. 9, the bars 32 form circular rings placed in planes transverse to the longitudinal winding axis O of the panel 40.

Moreover, the reinforcement 3 may also be completed by transverse bars 33 that are bent round so as to be applied on the inner face F of the gallery. As shown in FIG. 9, the bars 33 can advantageously be fastened in the support massif M by connecting means 36 associated to spacers that permit the adjustment of their position with respect to the inner face F, so as to compensate for the irregularities of the latter. Each transverse bar 33 thus forms a kind of template, on which the panel 40 comes and rests, during the unwinding thereof, at the tops of the corrugated stirrups 30.

Preferably, two metallic bands 45, 45' are fastened to two perpendicular consecutive sides of the panel, for example a lateral side 41' (FIG. 7) and a transverse side 44', each band 45, 45' being fastened over half the length thereof, so as to project from the panel to form a joint cover allowing the fastening side-to-side of the two lateral sides 41, 41' of a same panel or of the adjacent transverse sides of two consecutive sections.

Figure 10:
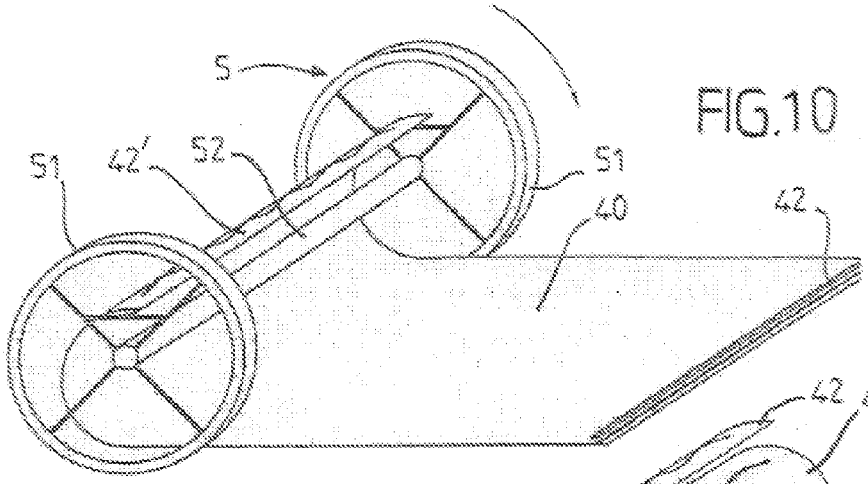
FIG. 10 is a schematic perspective view of the winding process of a lining panel.

After the placement of the side profiles 42, 42' and the reinforcements, the panel 40 thus made may be wound in the manner schematically shown in FIG. 10. To this end, a winding tool 5 is used, which comprises for example two circular plates 51 rotating around an axis 52 and on which may be fastened the ends of one of the profiles 42'. By rotating the plates 51 around their axis 52, the panel 40 is thus wound around the axis 52 over more than one turn so as to form an "overwound" panel schematically shown in FIG. 12, the diameter thereof d' is far lower than the diameter D of the gallery.

This overwound panel may then be introduced in the gallery, in the manner that will be described hereinafter, and unwound, so as to form the cylindrical wall, the two profiles 42, 42' being side-by-side and the sides 41, 41' being in contact.

Figure 14:
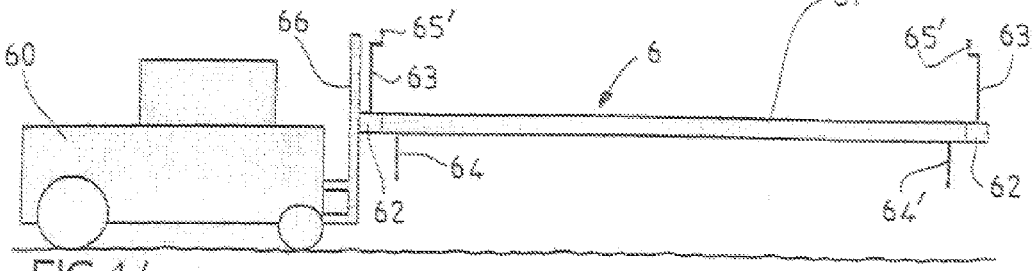
FIG. 14 shows a transport truck equipped with an unwinding tool.

For the placement and the unwinding of an overwound panel, an unwinding tool of the type shown in FIGS. 14, 15, 16 is advantageously used.

Generally, this unwinding tool 6 comprises a central shaft 61 mounted rotating around its axis on two rotationally-fixed bearings 62, each carrying two spaced-apart arms 63, 63', the rotating shaft 61 also carrying an arm 64, 64' at each end.

Figure 13:
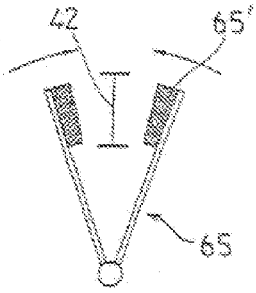
FIG. 13 is a detailed view of a clamping jaw.

Each pair of arms is provided with a clamping member 65 schematically shown in FIG. 13 and comprising two jaws hinged around an axis and provided with bearing parts 65' shaped so as to clamp the side profile 42 or 42' on both sides thereof.

Figure 11:
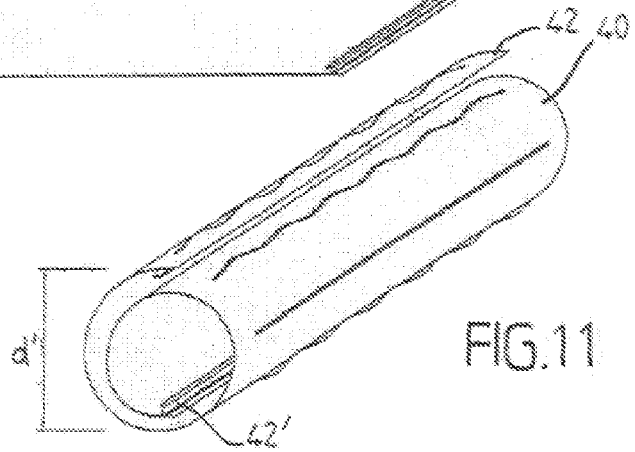
FIG. 11 is a perspective view of a wound-up panel.

After the winding of the panel 40 by means of the winding tool 5, the panel is kept momentarily in the overwound position shown in FIG. 11, for example by one or two outer belt (not shown).

The unwinding tool 6 is then inserted axially within the overwound panel 40. To this end, it is particularly advantageous to mount the unwinding tool 6 on a transport truck such as a lift truck 60 provided, at a front end thereof, with a swiveling frame on which a lift chassis 66 is usually mounted in a vertically sliding manner, comprising two arms forming a fork. According to the invention, it is advantageous to use as a transportation means a lift truck 60 of this type, the lift fork being replaced by the unwinding tool 6, whose central shaft 61 is fastened to the sliding lift chassis 66 and extends cantilevered forwardly therefrom.

The unwinding tool 6 thus carried by the truck 60 may be inserted axially into the overwound panel 40. The spacing of the arms 63, 63' mounted on the bearings 62 and rotationally fixed is a little greater than the length L1 of a panel so that the clamping jaws 65' carried by the two arms 63, 63' can engage respectively the two ends of the lateral beam 42 placed on the outer side of the overwound panel 40. In order to facilitate the insertion of the panel and the handling thereof, the fixed arm 65' placed at the front end of the rotating shaft 61 may furthermore be hinged around an axis orthogonal to the horizontal axis of the shaft 61.

On the other hand, the two arms 64, 64' mounted on the rotating shaft 61 are spaced apart by a distance lower than the length L1 of the panel 40 and their length is adjusted so that the jaws 65 placed at their ends can engage the profile 42' located inside the overwound panel. The latter is thus handled by the unwinding tool in the manner schematically shown on the left of FIG. 15.

It is to be noticed that a lift truck may have rather reduced dimensions and that, in particular, the overall height dimension thereof depends on the amplitude of the lifting movement. Now, in the case of the invention, this amplitude is small. Consequently, the unwinding tool 6 may be mounted on a truck whose dimensions are compatible with those of the gallery to be lined, in order to be introduced therein, as shown in FIGS. 15 and 16.

Indeed, as mentioned hereinabove, an aqueduct has generally a very long length of several tens of kilometer, and, thanks to the invention, it is possible to form, in the support massif, holes of sufficient dimensions for the introduction of a lift truck 60 and/or an overwound panel in the gallery, the truck resting, through rolling means, on the lower part of the inner face F of the gallery. The introduction orifice may thus be formed at a rather great distance from the location of placement of the lining, and the truck 60 carrying the unwinding tool and the overwound panel moves axially inside the gallery, up to the position of placement shown in FIG. 16. Given that the lining is formed of elementary sections placed end-to-end with respect to each other, the truck 60 will stay, preferably, inside the gallery, the overwound panels being introduced one after the other into the gallery, through the orifice formed in the roof of the latter.

FIG. 15 thus schematically shows an aqueduct consisting of a gallery G formed inside a support massif M and in which a lining 4 has already been made, in successive sections, up to a transverse edge 44*a* formed at the rear end of the last section 4*a* of the lining 4, in a plane perpendicular to the axis of the gallery.

The transport truck 60 being inside the gallery, a new overwound panel 40 is introduced in the latter, being slipped onto the unwinding tool 6 that handles it. The truck is then advanced up to the position shown in FIG. 15, where the new panel 40 is placed substantially to its position of placement, running on from the last section 4*a* of the already-made lining 4.

Figure 12:
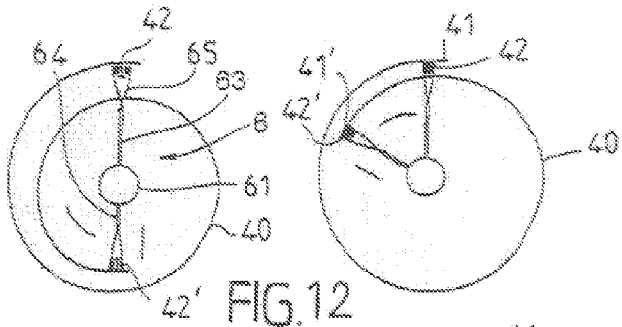
FIG. 12 shows the operation of an unwinding tool, in two successive steps.

The movable arms 64 are driven in rotation, which determines the unwinding of the panel 40 in the manner indicated on the right of FIG. 12, until the inner profile 42' goes beyond the position of the outer profile 22. As mentioned hereinabove, the profile of the unwound panel may be determined with some accuracy by the transverse bars 33 that form a template, this profile being moreover not necessarily circular.

The position is thus as shown in FIG. 16, and the opposite edges of the panel 40 can then be tightly sealed together, along the lateral sides 41, 41' of the new section 4*b* thus placed, as well as along the adjacent transverse sides, respectively 44*a* at the rear end of the last lining section 4*a* already placed 4*a* and 44*b* at the front end of the new section 4*b*.

As shown in detail in FIG. 17, the two ends 44*a*, 44*b* may simply be slipped into one another and be welded by contact. To facilitate the nesting of the adjacent ends, it may be advantageous to give a slightly truncated conical shape to each panel at the time of winding, the front end 44*b* having a diameter slightly smaller than that of the rear end 44*a*. In this case, the lateral sides 41, 41' of the panel 40 are not strictly parallel to each other, and the panel is slightly trapezoidal in shape.

Insofar as all the elements of the lining are metallic, it is possible and advantageous to make welded connections, and, to this end, not only the wall of each panel 40 of the lining but also all the other elements such as the reinforcements 3 and the profiles 42, 42' are made of stainless steel, the welding being facilitated by the use of metals of same nature. Furthermore, because the stainless steel has the advantage to be very lasting and easy to maintain, it is preferable to also make all the reinforcements of stainless steel, so as to increase the longevity of the lining while avoiding the risks of corrosion.

Moreover, it is advantageous to make the connexion of the opposite edges of the lining walls by welds that provide not only strength but also tightness to the structure, and that allow withstanding of inner or outer pressures of the order of 3 bars. However, the connexions may also be bonded, riveted or bolted, for example as shown in FIG. 18.

Indeed, as already described with reference to FIG. 8, the connexion between the lateral sides of a panel may be ensured by means of a joint cover 45 associated with a seal. A similar arrangement using a circular joint-cover 45' and a seal 46' may be used to make the connexion between the adjacent ends 44*a*, 44*b* of the section already placed 4*a* and of the new section 4*b*.

Preferably, at least the rotating arms 64 of the unwinding tool 6 have a variable length, for example by means of a telescopic assembly operated by a cylinder and may thus apply the new element against the face F of the gallery G as the unwinding thereof goes along. Likewise, because the rear end 44*a* and front end 44*b*, respectively, of the two consecutive sections are nested in one another, it is possible, as the circular application of the new section 4*b* to the preceding section 4*b* goes along, to drill holes into the section 4*a* already placed, passing through the end 44*b* of the section 4*b* to be placed and through the bonded seal 46'. As the unwinding goes along, stainless rivet are placed so as to apply the new section 4*b* and the bonded seal thereof against the preceding section 4. These progressive operations of drilling and tightening allow the stainless sheet of the section 4*b* to be placed in position while adapting to the compression of the seal by the rivets. When all the rivets of the circular connection of the new section 4*b* to the preceding section 4*a* have been placed, the spacing between the two profiles at the crown of the new section is controlled, and corrected if need be.

The sealing connection between the circular seal and the longitudinal seal may be made in a conventional manner.

When the aqueduct is in free flowing, it is possible to leave in place the side profiles 42, 42' that have served for the winding and unwinding processes and that may be placed at the upper part of the duct. However, it is often necessary to provide the duct with an entirely smooth inner face, in particular in case of flowing under pressure. In this case, it is necessary to remove the side profiles 42, 42' and it is thus preferable that the latter are fastened by bolts.

Besides, the gallery is not always rectilinear and it is sometimes necessary to form bends. To this end, the connection between two ducts having angularly offset axes may be made by means of a bend prepared in factory, according to the so-called "melon slice" technique used, for example, for the making of oleoducts. The elements are then assembled and riveted together on side, in the manner described hereinabove.

The fixing product filling the gap E between the lining 2 and the inner face 11 of the gallery may be injected after several consecutive sections have been placed. To this end, injection holes are drilled in factory, at a bottom end of each section and vent holes are formed at the opposite top end. The injected material may be, for example, a very plastic, 400-kg micro-concrete grout. After all the injection and vent holes have be opened, this concrete grout is injected though the bottom end and the injection is continued until the grout appears through the top vent hole, which is then closed like the bottom injection points.

It is to be noted in this respect that the use according to the invention of a metallic lining wall, also forming an inner reinforcement mat secured to the fixing product 10 by the corrugated bands 30, makes it possible, if need be, to calculate the reinforcement cage thus formed so that the latter withstands by itself the various stresses and, in particular, an inner or outer pressure.

The just-described technique allows a fast and cost-effective renewal of the lining of an existing aqueduct, but it could also be advantageously used for the construction of a new aqueduct. In this case, the lining could be made a little after the construction of the gallery, the transport truck 60 being then introduced simply through the open end of the latter.

As described hereinabove, the panels 40 provided with their profiles 42 and with the reinforcement 31, 32 may be made in a flat state, from a stainless steel coil.

The thus-made panels may also be transported in a flat state before the overwinding process. In this case, their dimensions must respect the road loading gauge.

To avoid the need to place too many elements, it is possible, as described hereinabove, to make panels formed of several adjacent strips so as to make elements of about 5 meter long, for example, the panels being then transported in their overwound condition shown in FIG. 12. For example, a semi-trailer would thus transport 8 overwound panels of 5 meter long.

Such an overwound panel may have a unit weight of about 400-500 kg, which corresponds to the lifting capacity of a little lift truck of the conventional type.

Of course, the invention is not limited to the details of the embodiments described hereinabove only by way of example, but covers on the contrary alternative embodiments using, for example, equivalents means, or other applications of this technique.

For example, as already said, the invention has been described in the case of a slab, with reference to FIGS. 1 and 2, but it may apply to other types of components such as beams or curved shells, the outer walls 11 and 12 being not necessarily parallel. On the other hand, the inner reinforcement 3 welded to the metallic wall 2, which constitutes the outer reinforcement mat, could be made in a different manner.

Furthermore, according to a technique previously described in the French patent 0350857 of the same inventor, it could be advantageous to form, inside the component, blocking zones spaced apart from each other and, between the latter, a sliding zone in which the corresponding part of the reinforcement that, in the invention, consists of the lining wall 2, is free to elongate over its whole length under the effect of absorbed loads, which permit the making of particularly flexible components without risk of cracking of the concrete.

On the other hand, even if the use, according to the invention, of the lining wall as a sacrificial formwork and a main reinforcement mat facilitates the making and the transportation of components made in advance, the technique according to the invention is not limited to the making of the prefabricated components.

Indeed, as the wall 2 forms a sacrificial formwork and has a certain rigidity thanks to the corrugated bands 30, it is possible, for example, for making a double-leaf wall, to place two vertical walls spaced apart from each other, alternating the corrugated bands to allow their imbrication, and to pour concrete into this gap, using a technique similar to the "shuttered concrete" technique.

The invention claimed is:

1. A method for making a waterproof lining in a cavity that is masoned or dug into natural ground, said lining comprising successive sections, each comprising a rectangular thin-wall panel with a length corresponding to a length of the section and a width corresponding to a cross-sectional perimeter of the cavity, positioning each thin wall panel in a flat configuration so as to place on an upper face thereof an inner reinforcement comprising at least a plurality of corrugated bands parallel to a longitudinal axis of the panel and spaced apart from one another, said bands being welded to the upper face of the panel at at least some tops of the corrugated bands, overwinding each thin wall panel using a winding tool comprising two circular plates rotating around an axis, on which plates are fastened ends of a profile arranged on one longitudinal side of the panel, which is wound over more than one turn by rotation of the plates about their axis, the corrugated bands being directed outwardly, introducing the overwound panel into the cavity up to a location of placement and unwinding the panel so as to rest a panel against the lateral face of the cavity at the tops of the corrugated bands, the panel being welded along the two longitudinal sides that have come into contact and along an end transverse side, to a corresponding end side of a section already in place, and injecting a moldable material such as concrete between the thin wall panel and the lateral face of the cavity, so as to embed the inner reinforcement and to secure a thus constituted whole lining, a size and structure characteristics of the thin wall panel and of the inner reinforcement being determined so that said whole lining is capable of withstanding loads applied by outward operational pressures and possible differential settlements of the cavity.

2. The method according to claim 1, wherein, each panel being provided with two profiles respectively arranged on the two longitudinal sides, each overwound panel is unwound with an unwinding tool comprising a central shaft carrying a pair of two movable arms at the ends of the arms and mounted rotating on two rotationally-fixed bearings, carrying respectively two spaced-apart fixed arms whose spacing is slightly greater than the length of said panel, said fixed arms and said movable arms being each provided with a clamping member, wherein said unwinding tool is inserted into the overwound panel so that the clamping members respectively carried by the fixed arms of the bearings engage the ends of the profile placed on the outer longitudinal side of the overwound panel whereas the clamping members of the movable arms of the central shaft engage the ends of the profile placed on an inner side of the overwound panel, wherein the overwound panel carried by said unwinding tool is then placed at the location of placement by advancing the tool inside the cavity and is thereafter unwound by rotating the movable arms until the inner profile goes beyond a position of an outer profile, and wherein the opposite edges of the panel are then tightly sealed together along the longitudinal sides as well as along the adjacent transverse sides, respectively of the last section already placed and of a new section.

3. The method according to claim 2, wherein the unwinding tool is mounted on a transport truck such as a lift truck, whose dimensions are compatible with those of the cavity to be lined, in order to be introduced therein.

4. The method according to one of claim 1, wherein the thin wall panel is made of a metal.

5. The method according to claim 1, wherein the thin wall panel is covered with a corrosion-resistant coating.

6. The method according to claim 1, wherein the thin wall panel is made of a material containing glass or carbon fibres.

7. The method according to claim 1, wherein the inner reinforcement consists of a plurality of thin bands having a portion welded to an inner face of the thin wall panel and a portion extending between the panel and the lateral face of the cavity.

8. The method according to claim 1, wherein the thin wall panel and the inner reinforcement in the form of bands are made of a material that is the same.

9. The method according to claim 4, wherein the metal of said thin wall panel is stainless.

* * * * *

UNITED STATES PATENT AND TRADEMARK OFFICE

CERTIFICATE OF CORRECTION

PATENT NO. : 8,453,413 B2
APPLICATION NO. : 12/667750
DATED : June 4, 2013
INVENTOR(S) : Marcel Matiere It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 517 days.

Signed and Sealed this
Eighth Day of September, 2015

Michelle K. Lee

Michelle K. Lee
*Director of the United States Patent and Trademark Office*